US008951061B1

(12) United States Patent
Bartell

(10) Patent No.: US 8,951,061 B1
(45) Date of Patent: Feb. 10, 2015

(54) CABLE CONNECTOR ASSEMBLY HAVING A TOP PART WITH INSULATION DISPLACING CONDUCTOR PINS PIVOTALLY CONNECTED TO A BASE PART

(71) Applicant: Jack R. Bartell, Marana, AZ (US)

(72) Inventor: Jack R. Bartell, Marana, AZ (US)

( * ) Notice: Subject to any disclaimer, the term of this patent is extended or adjusted under 35 U.S.C. 154(b) by 15 days.

(21) Appl. No.: 14/021,398

(22) Filed: Sep. 9, 2013

(51) Int. Cl.
*H01R 4/24* (2006.01)
*H01R 13/52* (2006.01)

(52) U.S. Cl.
CPC ..... *H01R 4/2412* (2013.01); *H01R 13/5221* (2013.01)
USPC ..... 439/409

(58) Field of Classification Search
USPC ..... 439/395–417
See application file for complete search history.

(56) References Cited

U.S. PATENT DOCUMENTS

| | | | | |
|---|---|---|---|---|
| 5,939,672 | A * | 8/1999 | Tang | 174/50.5 |
| 6,254,421 | B1 * | 7/2001 | Denovich et al. | 439/409 |
| 7,465,184 | B2 * | 12/2008 | Scherer et al. | 439/408 |
| 7,530,836 | B2 * | 5/2009 | Cox et al. | 439/409 |
| 7,753,716 | B2 * | 7/2010 | Cox et al. | 439/409 |
| 7,794,267 | B2 * | 9/2010 | Daily | 439/409 |
| 2008/0268718 | A1 * | 10/2008 | Cox et al. | 439/709 |

* cited by examiner

*Primary Examiner* — Chandrika Prasad
(74) *Attorney, Agent, or Firm* — Ushas Koshy

(57) ABSTRACT

A cable connector assembly with a base part containing a pivot hub with interlocking guide posts mates with the interlocking guide slots on a top part containing a pivot shaft. The shafts at the bottom end of the top part interlock with the pivot hub sockets on the base part at one end and upon rotation at ninety degrees the connector assembly is closed completely without risk of misalignment. Upon closure with nominal hand force, a pair of arc-shaped metal conductor pins molded to the top inside end of the top part easily penetrates a source conductor and fixture conductors held in separate conductor channels in the base part to connect the wires in the two sets of conductors electrically. The small diameter of circumference at the mid section of the uniquely designed cable connector allows for the use of an optional closure to secure the cable connector in place.

14 Claims, 11 Drawing Sheets

CABLE CONNECTOR ASSEMBLY HAVING A TOP PART WITH INSULATION DISPLACING CONDUCTOR PINS PIVOTALLY CONNECTED TO A BASE PART

FIELD OF THE INVENTION

This invention is generally related to low voltage connectors. More particularly, the present invention is related to a connector assembly with a detachable pivot shaft and pivot hub to electrically connect fixture conductors with a source conductor using metal conductor pins.

BACKGROUND OF THE INVENTION

Electrical cable connectors in general are well known in the art. In the past, electrical contact between cable conducting wires was normally achieved through soldering, crimping or insulation displacement of the cables. More recently, these methods have been replaced by the penetration method which comprises the use of metal conductors in the shape of spikes, or lances to pierce the insulation sheath of the cable conductors to facilitate electrical contact between the wires, thus obviating the need to cut open, or strip the cable insulation sheathing to make the wire contacts. This method is now popularly used in both high voltage and low voltage cable connector assemblies.

Low voltage, as described herein, apply to circuits that are exempt from the protection required for line voltage circuits such as conduits, breaker panels, ground fault interrupt devices etc. Low voltage circuits require a transformer that will modify a 110 v-220 v AC input and provide a 0 v-49 v DC output current. Low voltage circuits are used in the residential and light commercial markets primarily for landscape lighting and irrigation control. Low voltage circuits can be carried on direct burial wires (DBR) which do not require the use of conduit and junction boxes for electrical connections. Typically, the DBR is a flat dual conductor with a pair of individual wires held together by a small link of insulation that can be easily separated without exposing either individual wire.

Low voltage cable connectors are generally used to join, or connect cables that are part of an outdoor lighting system. The system is typically comprised of a set of conductor cables from a source, connecting to a set of conductor cables from the lighting fixture. The source conductor is the electrical current carrying wire pair from a low voltage source (commonly the low voltage transformer) and the fixture conductor is the wire that feeds the fixture and connects to the source conductor.

The common feature of a majority of the low voltage cable connectors is in the use of a metal conductor with a sharp pointed end that penetrates or partly displaces the insulating jackets of a source conductor and a fixture conductor to bring them into electrical contact with each other. The use of such a metal conductor obviates the need to tear open, or strip a major segment of the insulation of both the source conductor and fixture conductor cables in order to bring them into electrical contact with each other.

Many of the popular brands of low voltage connectors available in the market today have significant deficiencies in their construction and operation. For example, in one of the popular brands of the low voltage connectors in the market, the metal conductor spikes used to establish the contact with the wiring within the cables is reported to have a tendency to bend, thereby limiting the connector's capability to effectively pierce the insulated sheathing of the cables to electrically connect the source conductor and the fixture conductor.

Many of the most popular low voltage connectors are prone to misalignment of the metal conductor element, which prevents the conductor from making contact with the current-carrying inner metal strands of the target conductor wire. The other limiting feature of some of the low voltage connectors in the prior art are their incapacity to hold and pierce the better quality low voltage cables with a thicker insulating sheathing. A major drawback of the low voltage connectors in the prior art is in their inability to protect the connection from excessive moisture and oxygen which causes corrosion and ultimately failure of the electrical connection. Some of the low voltage connectors used for outdoor lighting and other tasks are also known to be constructed of poor quality plastic that can melt or turn brittle from prolonged exposure to the elements.

The above described deficiencies as well as others in the prior art low voltage cable connectors has prompted the need to construct a better quality cable connector that is sturdy, efficient and capable of withstanding the harsh outdoor elements. It is believed that the present invention of a cable connector with a detachable pivot shaft and pivot hub meets these needs and overcomes the deficiencies of the prior art low voltage cable connectors.

SUMMARY OF THE INVENTION

The present invention is a low voltage cable connector primarily used to connect low voltage light stranded wire fixture conductors to stranded wire source conductors.

It is an object of the present invention to provide a low voltage cable connector that has sturdy metal conductor pins capable of piercing the insulated sheathings of a source conductor and a fixture conductor of a quality gauge and thickness, with limited damage to both the source and fixture conductors upon penetration of their stranded wires.

It is a further object of the present invention to provide a low voltage cable connector that enables a water tight connection between insulated direct burial wire (DBR) pairs of varying gauges without the need to remove, cut, or strip the insulation, from either the fixture or source conductors.

The exemplary embodiment of the cable connector of the present invention, has a uniquely shaped design having a detachable base pivot hub and a top pivot shaft that can be separated completely into their respective parts and further allows them to engage and disengage an unlimited number of times. In this embodiment, the connector assembly connects two sides of a source conductor to the corresponding two fixture conductors. Further in this embodiment of the invention, the metal conductor pins used to penetrate the source and fixture conductors have a special arc design to enable accurate and easy penetration of the conductor wires. In addition, the specially designed ridges on the top and base parts of the connector assembly create a water tight seal with the source conductor insulation sheath when they are fully closed. Further in this embodiment of the invention, the interlocking guide posts in the base part and the slots in the top part fully align the metal conductor pins with the center of the source conductor and the corresponding fixture conductor as the assembly is rotated ninety degrees from the open position to the fully closed position. These interlocking posts and slots engage with sufficient friction to prevent the assembly from recoiling open and will further retain the assembly in the fully closed position in the absence of an external force which may cause the assembly to open partially or completely. In addition, the embodiments of the connector assembly have a unique shape which presents the smallest circumference of the closed assembly such that it can be permanently secured with a variety of closure devices without the possibility of the closure device sliding out of position unless it is loosened or completely detached. Such closure devices include, but are not limited to, custom designed plastic, metallic, or nylon accessories, or readily available commercial devices such as zip ties, clips, wires, tapes, and clamps.

In the exemplary embodiment of the cable connector of the present invention, the design of the connector assembly provides separate conductor wire channels which hold the wires securely in place and allow for the precise vertical penetration of the conductor pins through the source conductor and the fixture conductors. This embodiment of the cable connector of the invention, allows the use of a 12 American Wire Gauge (12 AWG) source conductor and 18 American Wire Gauge (18 AWG) fixture conductors.

In yet other embodiments of the cable connector of the present invention, the source conductor holding channels in the base part containing the pivot hub have varied widths to allow for the use of a 10 AWG source conductor as in embodiment two and/or 14 AWG and 16 AWG source conductor as in embodiment three of the invention. All embodiments of the cable connector of the present invention, allow for the use of 18 AWG or 16 AWG fixture conductors. All embodiments of the cable connector of the present invention are constructed of injection molded plastic except for the metal conductor pins.

In this summary of the cable connector of the present invention describing the objects and embodiments of the invention and in the specification in general, references to "the exemplary embodiment, or "yet other embodiments" do not necessarily all refer to the same embodiment(s). Rather, the references to the various embodiments mean that a particular feature, structure, or characteristics described in conjunction with a specific embodiment is included in at least some embodiments, but not necessarily all embodiments of the invention. The objects, embodiments and features of the cable connector of the present invention as described in this summary of the invention will be further appreciated and will become obvious to one skilled in the art when viewed in conjunction with the drawings, detailed description of the invention and the appended claims.

DETAILED DESCRIPTION OF THE INVENTION

The present invention is a cable connector assembly with a detachable pivot shaft and pivot hub to connect the primary 0 v-49 v DC direct burial source conductor (DBR) to fixture conductors used in outdoor lighting and irrigation systems.

Figure 1:
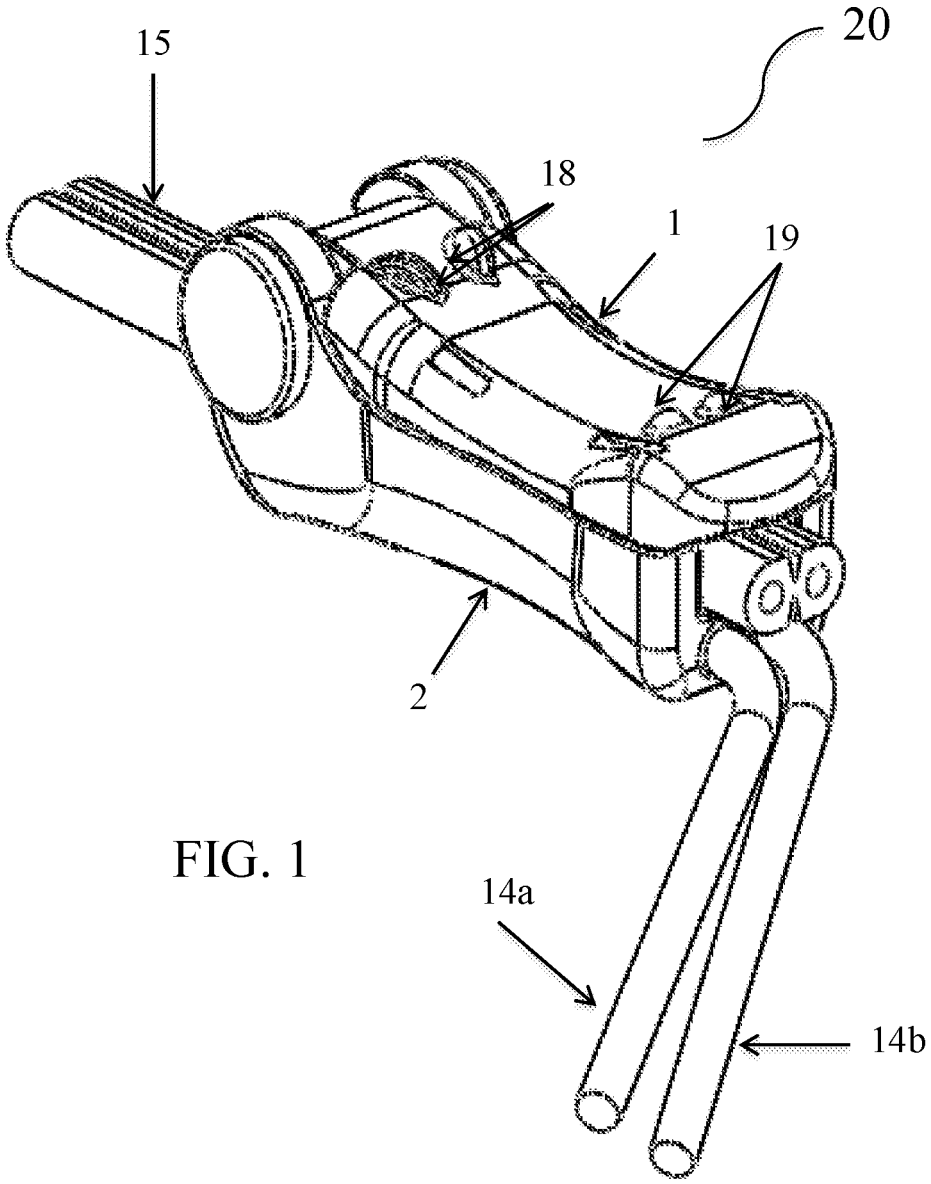
FIG. 1 is a perspective view of the exemplary embodiment of the cable connector assembly of the present invention.

Referring now to the drawings, more particularly to FIG. 1 a perspective view of the exemplary embodiment of the cable connector 20 of the present invention is shown having a unique alligator design with eyes 18 and nostrils 19. In this embodiment of the cable connector 20 shown in the closed configuration, the interlocking guide posts and slots (not seen) are fully aligned, holding the top part 1 containing a pivot shaft and a base part 2 containing a pivot hub together with friction, as the parts fit together with zero tolerance between the guide posts on the base part 1 and the slots on the top part 2 (not seen in this figure). FIG. 1 further shows the unique design of the cable connector 20 with the smallest circumference of the closed assembly presented in the mid section of the device which enables the use of a closure device to achieve permanent closure of the assembly. The protruding eyes 18 and the protruding nostrils 19 of the alligator shape of the cable connector 20 besides augmenting the visual and aesthetic appeal of the connector assembly also have a functional role in positioning a closure device around the mid section of the connector assembly. In this perspective view of the exemplary embodiment of the cable connector 20 which is shown in its functional closed position, a source conductor 15 and a pair of fixture conductors 14*a* and 14*b* are seen inserted into the base part 2 containing the pivot hub with the source conductor 15 lying parallel on top of the fixture conductors 41*a* and 14*b* which are placed into the conductor channels (not seen in this view) configured on the inside of the base part 2. In this closed position of the connector assembly 20 the metal conductor pins (not seen) which are molded on the inside of the top part 1 just below the nostrils 19 would have penetrated the source conductor 15 and the pair of fixture conductors 14*a* and 14*b* to provide the electrical connection between the sets of wires in the source conductor and the fixture conductors. In addition to positioning source conductor 15 and fixture conductors 14*a* and 14*b* for accurate and effective penetration of the metal conductor pins (not shown) upon closure, the placement of the fixture conductors 14*a* and 14*b* below the uncut source conductor 15 in the closed assembly of connector 20 serves to protect the smaller and less durable fixture conductors 14*a* and 14*b* from damage or displacement risks present in the harsh outdoor environment.

Figure 2:
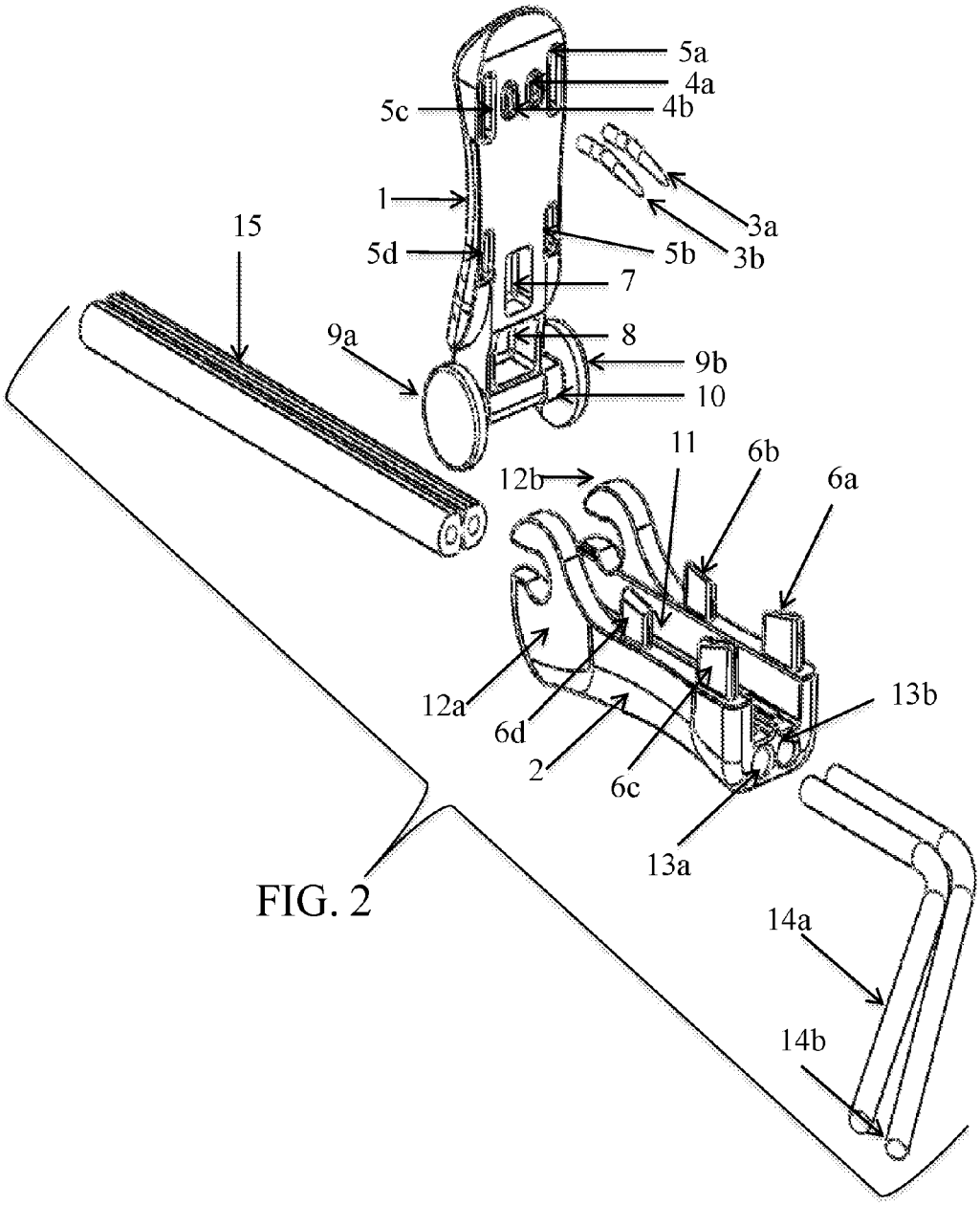
FIG. 2 is an exploded view of the exemplary embodiment of the cable connector of the present invention with all the parts within the structure clearly delineated.

Referring now to FIG. 2 an exploded view of the cable connector 20 is shown. This view shows the top part 1 containing the pivot shaft separated from the base part 2 containing pivot hub. In this view, the source conductor 15 and the fixture conductors 14*a* and 14*b* are seen placed alongside the base part 2. In this embodiment, the source conductor 15 is a standard, 12 American Wire Gauge (AWG), direct burial wire (DBR). The fixture conductors 14*a* and 14*b* have wires that are standard 18 AWG and fit exactly into the fixture conductor channels 13*a* and 13*b* respectively. The fixture conductor channels 13*a* and 13*b* allow the fixture conductors 14*a* and 14*b* to slide in approximately 20 mm and position directly under the metal pin conductor slots (not seen) in the base part 2 containing the pivot hub. In the exemplary embodiment, the round metal conductor pins 3*a* and 3*b* are 1.52 mm×14 mm and in all embodiments the round metal conductor pins 3*a* and 3*b* are shaped to a fine point for precision piercing of the stranded electrical cable wires. Each 3*a* and 3*b* round metal conductor pin is attached to pin molds 4*a* and 4*b* respectively. The pin molds, 4*a* and 4*b* have raised ridges to compress into the source conductor insulation sheath upon closure to create a water tight seal with the source conductor 15. In all embodiments, the unique shape and profile of the top part 1 containing the pivot shaft supports use of a closure device that will not slip away from the mid section holding the parts when closed in full assembly. The top part 1 also has interlocking guide slots 5*a*, 5*b*, 5*c* and 5*d* which mate precisely with the interlocking guide posts 6*a*, 6*b*, 6*c* and 6*d* respectively on the base part 2 containing the pivot hub. A pivot shaft 10 at the base of the top part 1 is shaped to slide into the base part 2 pivot hub sockets 12*b* when the top part 1 is aligned at 90° to the base part 2. Pivot shaft caps 9*a* and 9*b* align the top part 1 containing the pivot shaft to the base part 2 containing the pivot hub when the top part 1 is aligned at 90° to the base part 2 and inserted laterally. Cavities 7 and 8 on the inside surface of the top part 2 are created to reduce the material in the plastic mold and retain strength and stiffness of the parts. A source conductor channel 11 supports different wire gauges for the various embodiments of the cable connector assembly of the present invention. The pivot hub sockets 12*a* and 12*b* have a special design that allows the top part 1 to slide smoothly and effortlessly into the base part 2 when the top part 1 is at a 90° angle to the base part 2 and facilitates the top part 1 to rotate 90° to a fully closed position. When the top part 1 is initially rotated 5° toward closure, the top part 1 with the pivot shaft is locked into the base part 2 with the pivot hub and cannot be removed from the base part 2 preventing the two from separating or even moving forward, aft, or deflecting side to side which would cause misalignment of the conductor pins 3*a* and 3*b* with the corresponding center of the source conductor 15 and the fixture conductors 14*a* and 14*b*.

Figure 3:
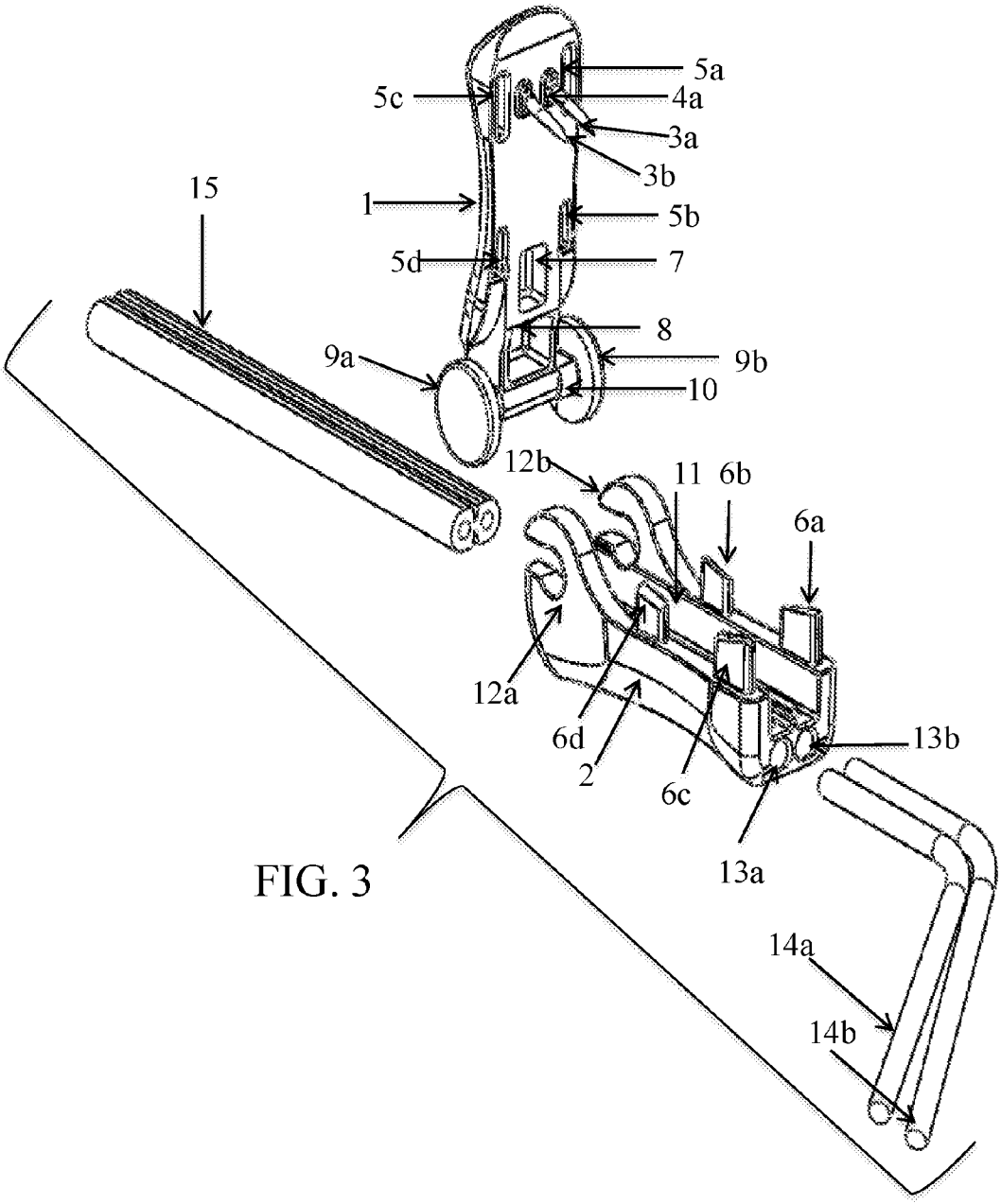
FIG. 3 is another exploded view of the cable connector of the present invention illustrating in particular the round metal conductor pins attached to the respective molds on the top part of the connector assembly.

Referring now to FIG. 3 another exploded view of the cable connector 20 of the present invention is shown with the round metal conductor pins 3*a* and 3*b* securely molded to the pin molds 4*a* and 4*b* respectively. The metal conductor pins 3*a* and 3*b* may be of variable length based on the source conductor 15 gauge supported by further embodiments of the present invention. The exemplary embodiment of the cable connector 20 uses a 12 AWG source conductor 15. the second embodiment 30 seen in FIG. 12 and FIG. 16 uses a 10 AWG source conductor 15, and the third embodiment 40 seen in FIG. 13 and FIG. 17 uses a 14 AWG and a 16 AWG source conductor 15. A unique feature of the design of the cable connector 20 and all its embodiments is the provision of separate and secure conductor channels for the source conductor 15 and the fixture conductors 14*a* and 14*b*. The source conductor 15 channel 11 lies laterally and horizontally over the fixture conductors 14*a* and 14*b* fixture conductor channels 13*a* and 13*b*. Once the fixture conductors 14*a* and 14*b* are inserted into the fixture conductor channels 13*a* and 13*b* they cannot move laterally and remain centered in the fixture conductor channels 13*a* and 13*b*. By, thus confining and isolating the fixture conductors 14*a* and 14*b* they are always targeted precisely for the penetration of the metal conductor pins 3*a* and 3*b* with the result, the pins pass vertically into the two sets of wires when the connector assembly is in a closed position.

Figure 4:
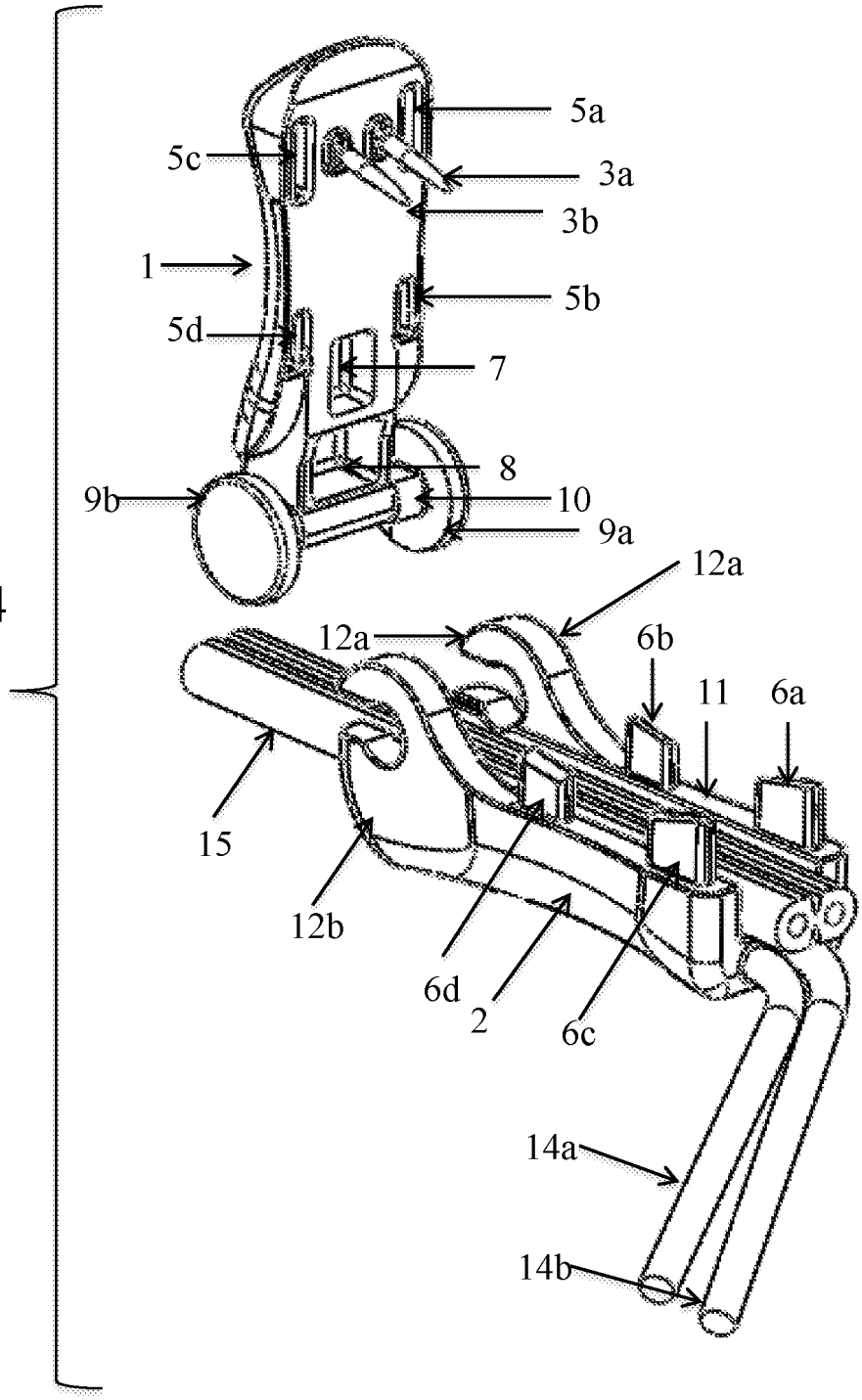
FIG. 4 is an exploded view of the cable connector of the present invention illustrating the manner in which the source conductor is aligned and inserted over the fixture conductors when placed in their respective conductor channels.

FIG. 4 shows yet another exploded view of the cable connector 20. In this figure, the source conductor 15 is seen lying horizontally in the source conductor channel 11 in the base part 2 with the fixture conductors 14*a* and 14*b* inserted into the respective fixture conductor channels (not seen) prior to assembling the top part 1 containing the pivot shaft and the base part 2 containing the pivot hub and closing the connector assembly to achieve penetration of the sets of wires by the metal conductor pins 3*a* and 3*b*. Having the top part 1 containing the pivot shaft and the base part 2 containing the pivot hub as separate units, allows for the placement of the source conductor 15 into the source conductor channel 11 without cutting or damaging the source conductor 15 in any way. Further, by leveraging the connection of the top part 1 containing the pivot shaft and the base part 2 containing the pivot hub, to one end of the connector assembly, the connector is positioned to survive the use of sufficient rotate and close forces needed to penetrate both the source conductor 15 and the fixture conductor 14 *a* and 14*b* by the metal conductor pins 3*a* and 3*b*.

Figure 5:
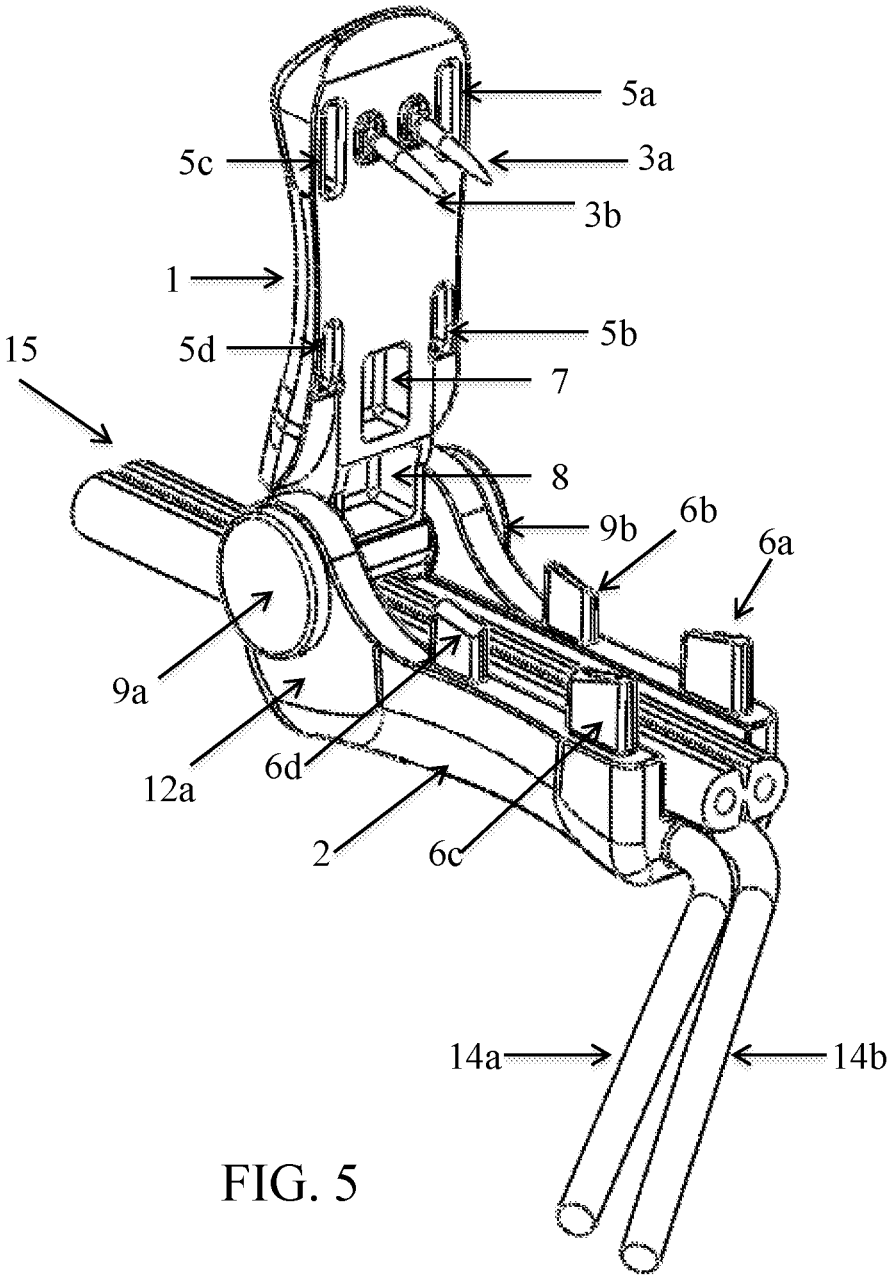
FIG. 5 is a perspective view showing the top part containing the pivot shaft inserted into the base part containing the pivot hub at a 90° angle.

FIG. 5 is a perspective view showing the assembly of the top part 1 containing the pivot shaft inserted into the base part 2 containing the pivot hub section at a 90° angle. When the top part 1 is thus positioned at a 90° angle to the base part 2 it slides into the base part 2 containing the pivot hub effortlessly and upon rotation towards closure, the two parts interlock in a manner that prevents their movement in any direction. The interlocking of the top part 1 and the base part 2 is supported by the interlocking guide posts 6*a*, 6*b*, 6*c* and 6*d* on the base part 2 engaging precisely with the interlocking guide slots 5*a*, 5*b*, 5*c* and 5*d* on the top part 1 with zero tolerance. As the connector assembly is closed, the interlocking guide posts and the interlocking guide slots nearest to the pivot hub 2 engage before the metal conductor pins 3*a* and 3*b* contact the insulation of the source conductor. The metal conductor pins 3*a* and 3*b* are then aligned in the exact center of the source conductor 15. The interlocking guide posts 6*a*, 6*b*, 6*c*, and 6*d* on the base part 2 align with the interlocking guide slots 5*a*, 5*b*, 5*c* and 5*d* on the top part 1 and engage with sufficient friction to prevent the assembly from recoiling open. In general, the hold force of the interlocking slots and guide posts is sufficient to keep the entire connector assembly closed with complete electrical connection. In this embodiment of the present invention, the use of an additional closure device is optional since, without an outside force, the posts and the slots have sufficient friction to secure the assembly closed permanently. A unique feature of all embodiments of the connector assembly of the present invention is that the closure radius of the base part 2 with the pivot hub and the top part 1 with the pivot shaft matches the arc of the conductor pins 3*a* and 3*b* and thereby allows the pins to pass through the source conductor 15 and the fixture conductors 14*a* and 14*b* with a minimum displacement of insulation or the stranded wire of the source conductor 15 and further allows for the sets of conductor wires to be penetrated by the pins completely with just the use of nominal hand force. The complete penetration of the source conductor 15 secures it in place within the connector assembly and consequently cannot be moved or pulled out from the assembly without the use of extreme force. This method of penetration, imparting little to no damage to the source conductors, allows the source conductor to perform as designed after the connector assembly is completely detached and removed. Upon penetration by the metal conductor pins 3*a* and 3*b* through the fixture conductors 14*a* and 14*b* the stranded wires expand to allow for the volume displacement of the conductor pin mass. Such displacement, compresses the fixture conductors 14*a* and 14*b* insulation sheathing against the conductor channels 13*a* and 13*b* creating additional friction and thereby holding them in place.

Figure 6:
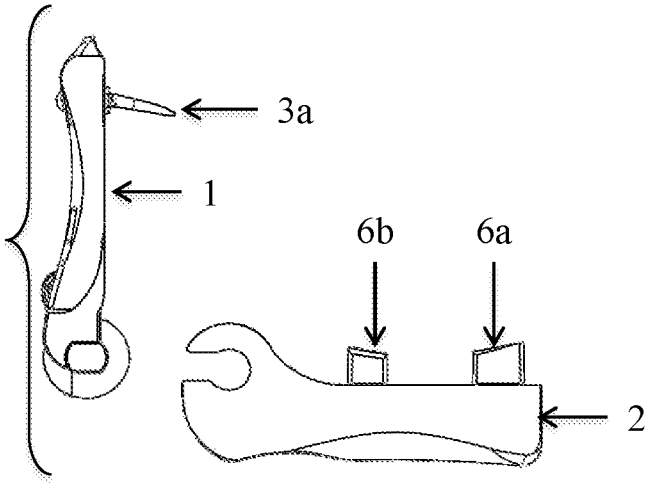
FIG. 6 is an exploded perspective view of the separated top part containing the pivot shaft and the base part containing the pivot hub.

FIG. 6 is an exploded perspective view of the separated top part 1 containing the pivot shaft and the base part 2 containing the pivot hub, further illustrating the design and shapes of the two parts which allows them to interlock by having the top part 1 slide effortlessly into the base part 2 at a 90° angle and rotate closed freely.

Figure 7:
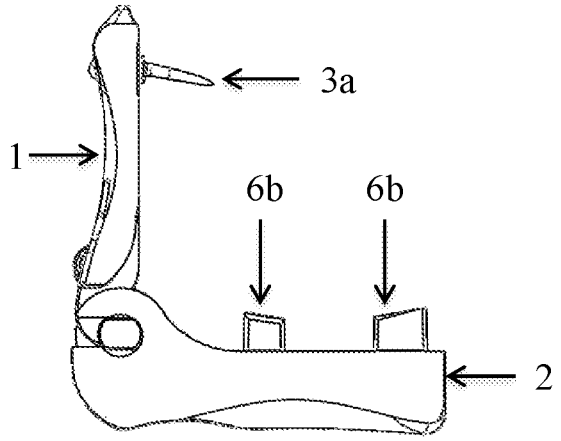
FIG. 7 is a perspective view of the top part containing the pivot shaft and the base part containing the pivot hub joined together at a 90° angle at one end of the connector assembly.

FIG. 7 is a perspective view of the top part 1 containing the pivot shaft and the base part 2 containing the pivot hub joined together at a 90° angle and shows the lateral movement of the top part 1 into the base part 2.

Figure 8:
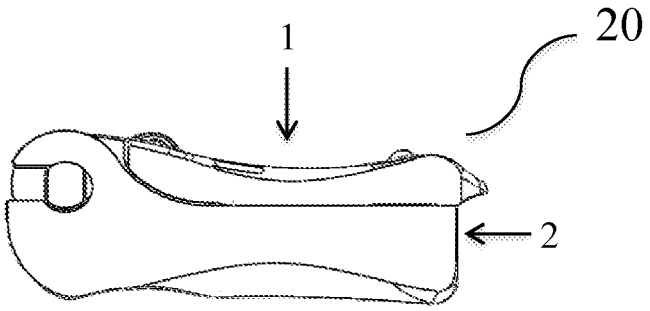
FIG. 8 is a perspective view of the top part containing the pivot shaft and the base part containing the pivot hub interlocked together to form the cable connector of the present invention.

FIG. 8 is a perspective view of the top part 1 containing the pivot shaft and the base part 2 containing the pivot hub interlocked together to form the cable connector 20 of the present invention. The pivot shaft caps (not seen in this view) insure alignment of the two parts and prevent their side to side movement at any point of the closure. The unique design of the top part 1 containing the pivot shaft and the base parts 2 containing the pivot hub prevents the two structures from moving in any direction and the assembly from releasing or separating once rotated 5° toward closure and through full closure.

Figure 9:
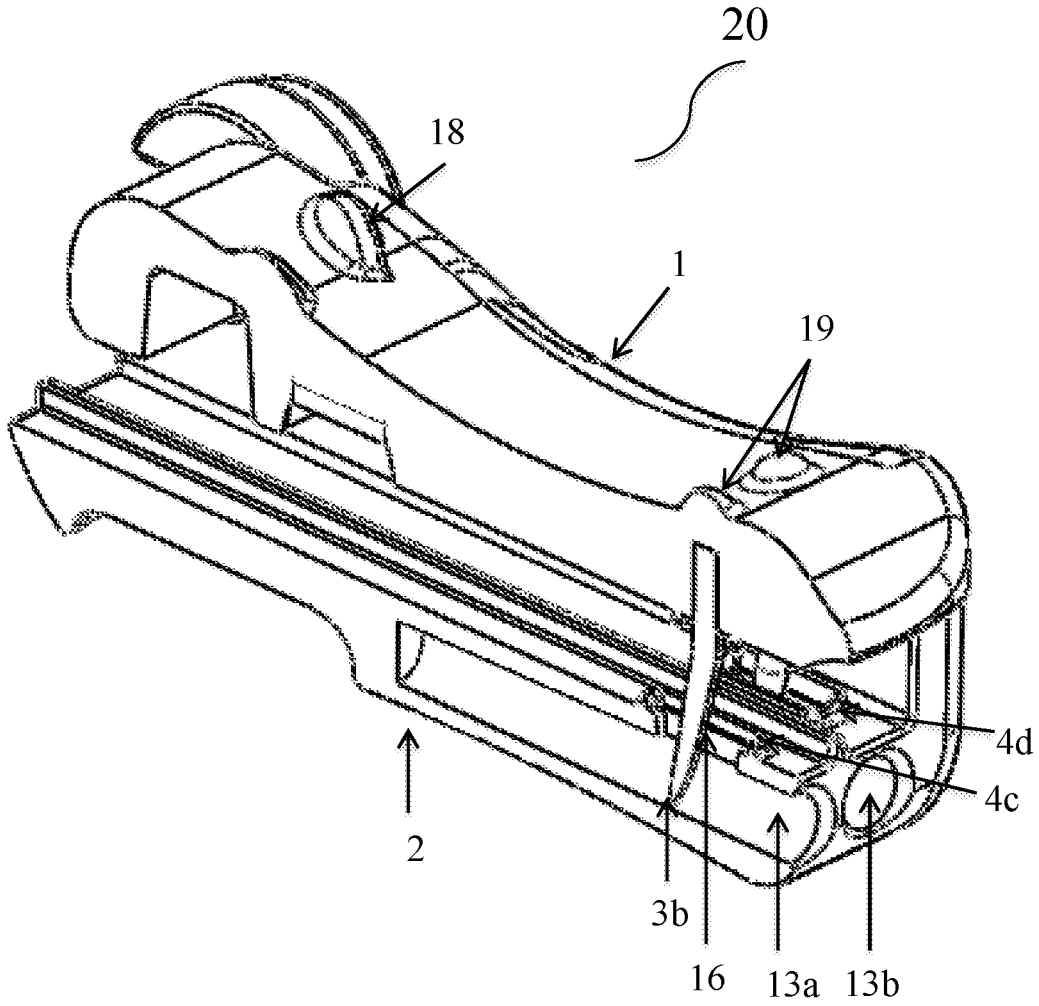
FIG. 9 is a cutaway side view of the exemplary embodiment of the cable connector of the present invention illustrating in particular the conductor pin passing through a pin conductor slot on the base part between the source conductor channel and the fixture conductor channel (s).

FIG. 9 is a cutaway side view of the cable connector 20 of the exemplary embodiment of the present invention illustrating in particular the length of the conductor channel 13*a* on the base part 2 containing the pivot hub. The length of the conductor channels are generally 25 mm to insure that the fixture conductors (not shown) are secured in place within the conductor channels, 13*a* and 13*b*. In addition, the shape of the fixture conductor channels 13*a* and 13*b* insure that the fixture conductors slide in easily and completely and cannot be misaligned with the conductor slot 16 in the base part 2 for the passage of the metal conductor pin 3*b* shown in this view and the metal conductor pin 3*a* on the opposite side (not shown in this view). The view also shows the depth of the molding in of the metal conductor pin 3*b* and the penetration path as all the parts rotate to full closure. The figure also illustrates the smallest circumference being near the mid section of the connector assembly 20 which insures the secure placement of a closure device. In this embodiment, the positioning of the alligator eyes 18 and the nostrils 19 are shown which also aid in positioning a closure device in place around the connector assembly when it is fully closed. The fixture conductor channels 13*a* and 13*b* on the base part 2 containing the pivot hub, allow for the insertion of a water-proofing agent such as silicone grease. Upon insertion of the fixture conductor (not shown) into the conductor channel 13*a* the silicone grease is displaced around the sheathing of the fixture conductor and into the pin slot 16 above the fixture conductor in the base part 2. The fixture conductor is fully encased in the water-proofing agent during this process. When the connector 20 is fully closed, the silicone grease augments the water tight seal achieved by the ridges along the molds (not seen) on the top part 1 and the ridges 4*c* and 4*d* base part 2 against the plasticized insulation of the source conductor (not shown).

Figure 10:
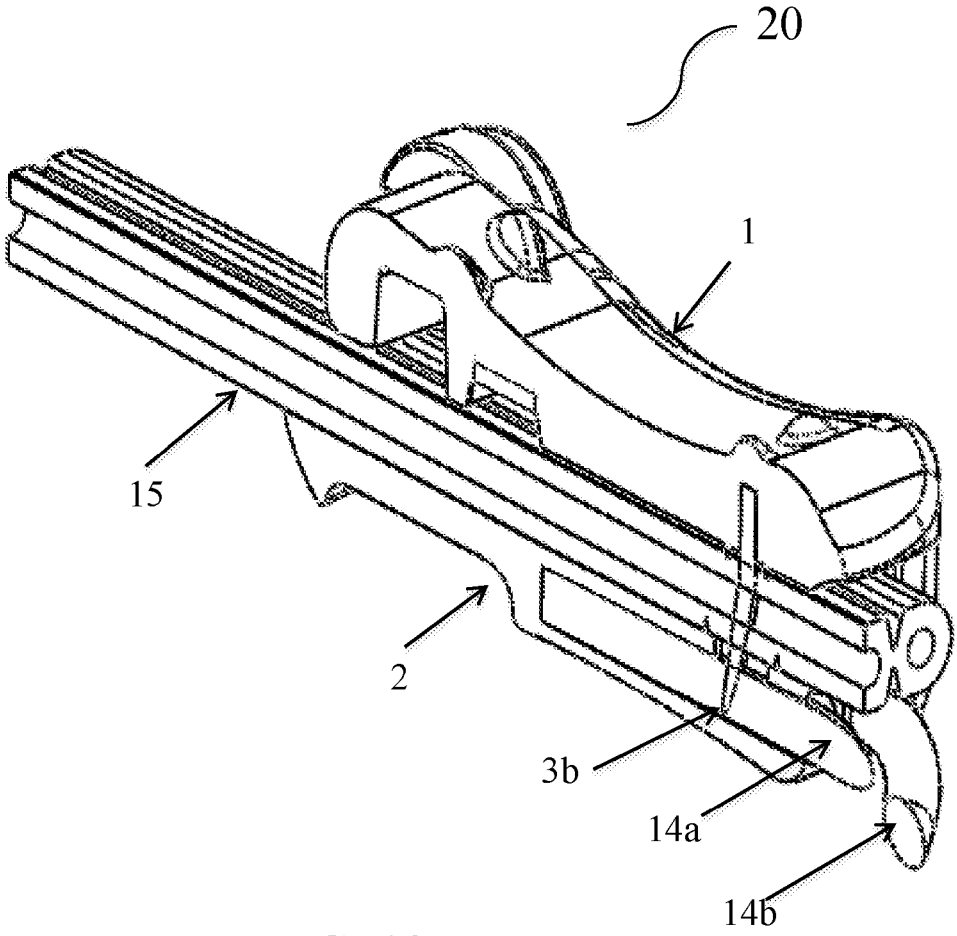
FIG. 10 is another cutaway side view of the cable connector of the present invention with the source conductor and fixture conductors in place showing in particular the extent of penetration of the metal conductor pins through both the sets of conductor cables.

FIG. 10 is another cutaway side view of the cable connector 20 of the present invention with the source conductor 15 and fixture conductors 14*a* and 14*b* in place showing the extent of penetration of the metal conductor pin 3*b* through both the sets of conductor cables. The metal conductor pins in the connector assembly in general penetrate 95% of the way through the fixture conductors. (Note: This is a general observation regarding both the metal conductor pins and not just metal conductor pin 3*b* shown in this figure).

Figure 11:
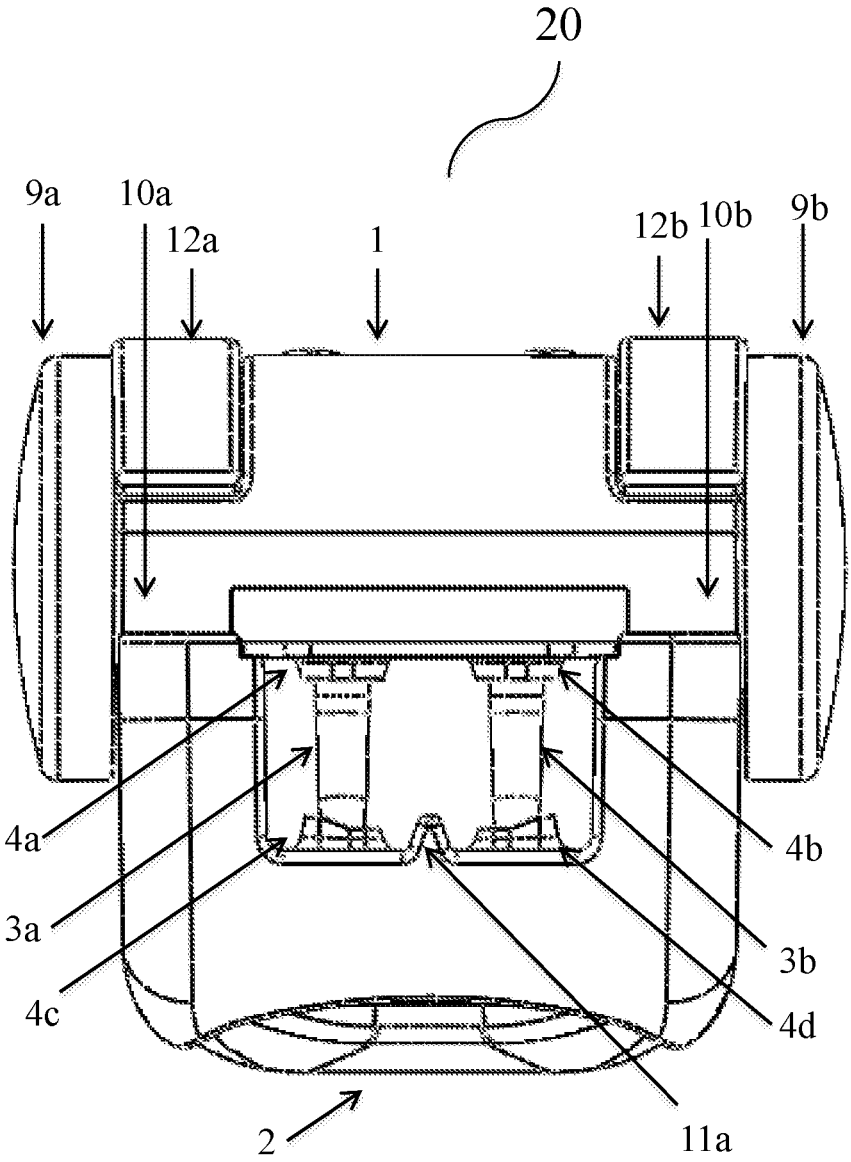
FIG. 11 is a perspective view from the back of the exemplary embodiment of the cable connector of the present invention with all parts interlocked.

FIG. 11 is a perspective view from the back of the exemplary embodiment of the cable connector 20 of the present invention when it is fully assembled with the pivot shafts 10*a* and 10*b* and the pivot caps 9*a* and 9*b* on the top part 1 and the pivot hubs 12*a* and 12*b* in the base part 2 interlocked. The figure shows the raised ridges 4*c* and 4*d* on the base part 2 containing the pivot hub and the raised ridges with the pin molds 4*a* and 4*b* on the top part 1 containing the pivot shaft that compress into the source conductor sheathing upon closing, creating a water tight seal between the source conductor and the base part 2 and the top part 1 when the assembly is fully closed. The profile and tapered shape of the raised ridges 4*a*, 4*b*, 4*c*, and 4*d* enables the use of source conductor from multiple manufacturers producing standard AWG flat dual conductor wire (DBR). A raised ridge 11*a* that runs the entire length of the source conductor channel 11 (not shown) of the base part 2 keeps the source conductor in the exact center and insures center penetration of conductor pins 3*a* and 3*b* on closure. In all embodiments of the cable connector of the present invention, both the top and bottom of the source conductor are sealed water tight by ridges that are compressed into the plasticized insulation of the source wire upon closure of the connector assembly.

Figure 12:
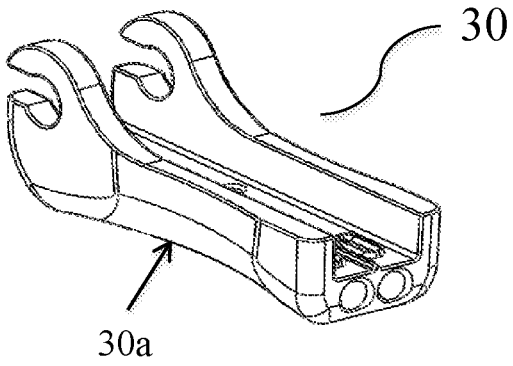
FIG. 12 is a perspective view of the second embodiment of the cable connector of the present invention with a base which is structurally different from the base of the first, exemplary embodiment of the invention.

FIG. 12 shows a perspective view of the second embodiment 30 of the cable connector assembly with a modified base part 30*a*. In this embodiment of the cable connector of the present invention, the top part 1 (not shown) has the same structure as the top part 1 in the exemplary embodiment 20 of the invention. The base part 30*a* containing the pivot hub of this second embodiment 30 of the cable connector assembly supports a 10 AWG without the need for an insert.

Figure 13:
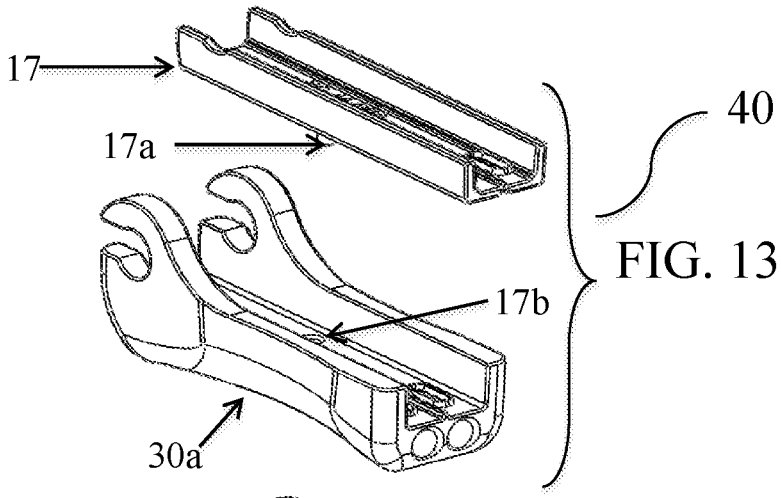
FIG. 13 is an exploded view of the third embodiment of the cable connector assembly of the present invention showing the optional use of an insert with the base of embodiment two of the invention.

FIG. 13 is an exploded view of the third embodiment 40 of the cable connector assembly of the present invention. This view shows an optional insert 17 that can be inserted into the base part 30*a* containing the pivot hub by means of an insert post 17*a* on the base of insert 17 which aligns with a void 17*b* in the base part 30*a* and insures the exact placement of insert 17 into the base part 30*a* of embodiment 40. The insert 17 allows adjustment to the base part 30*a* to support smaller source conductors. The insert 17 may be of varying size depending upon the source conductor AWG.

Figure 14:
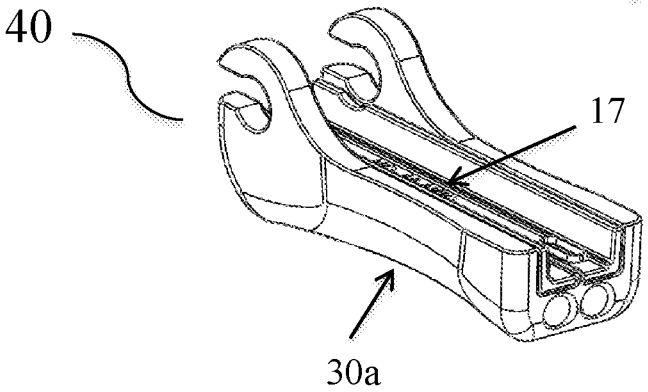
FIG. 14 is a perspective view of the third embodiment of the present invention with the insert in place on the base that is structurally the same as the base in the second embodiment of the invention.

FIG. 14 is a perspective view of the third embodiment 40 of the cable connector assembly of the present invention with the insert 17 in place on the base 30*a*. Optionally a different size insert 17 may be used for embodiment 40 of the cable connector of the present invention to accommodate smaller gauge source conductors.

Figure 15:
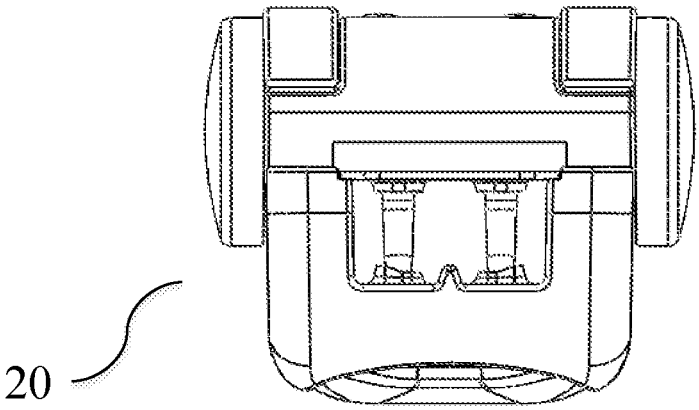
FIG. 15 is a perspective view from the back side of the first, exemplary embodiment of the cable connector of the present invention.
Figure 16:
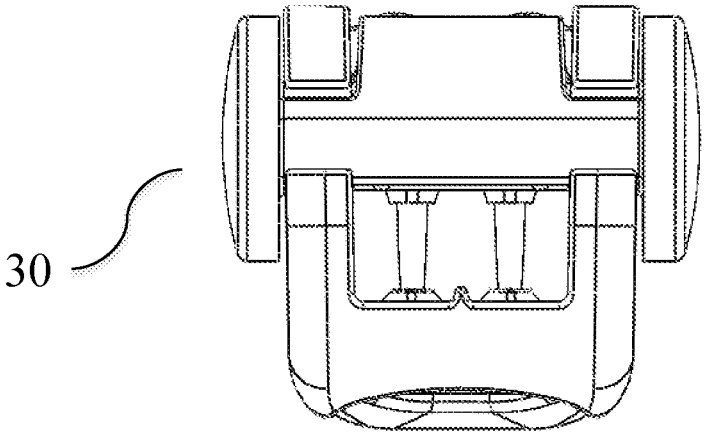
FIG. 16 is a perspective view from the back side of the second embodiment of the cable connector of the present invention.
Figure 17:
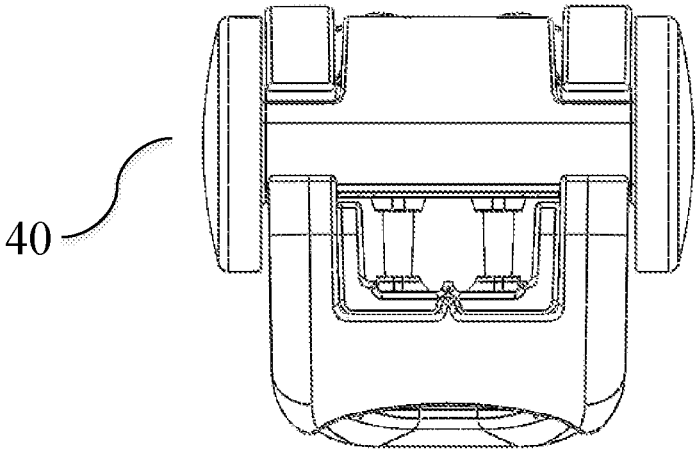
FIG. 17 is a perspective view from the back side of the third embodiment of the cable connector of the present invention.

FIG. 15 FIG. 16 and FIG. 17 show respectively, the views from the back end of the three embodiments 20, 30, and 40 of the cable connector assembly of the present invention. Embodiment 20 uses a 12 AWG source conductor with the standard fixture conductors. Embodiment 30 uses a 10 AWG source conductor with the standard fixture conductors. Embodiment 40 uses a 14 AWG source conductor with the standard fixture conductors. Embodiment 40 is variable with different size inserts to support small gauge source conductors.

The foregoing description of the invention through its figures and preferred embodiments should not be construed to limit the scope of the invention. It is to be understood that the embodiments of the present invention as described herein do not limit any application or scope of the invention and that the invention can be carried out and practiced in various ways and implemented in embodiments other than the ones outlined in the description above. It is to be further understood that the phraseology and terminology used to describe the invention are for descriptive purposes only. It should be understood and obvious to one skilled in the art that alternatives, modifications, and variations of the embodiments of the present invention may be construed as being within the spirit and scope of the appended claims.

What is claimed is:

1. A cable connector assembly comprising:

a top part containing a pivot shaft structure member having interlocking guide slots;

a base part containing a pivot hub structure member having interlocking guide posts to mate with said interlocking guide slots on the said pivot shaft structure member;

said base part containing the said pivot hub structure member having specially shaped pivot hub sockets at the top end of said pivot hub structure member;

said top part containing the said pivot shaft structure member having specially shaped pivot shafts at bottom end of said pivot shaft structure member;

said specially shaped pivot shafts of said top pivot shaft structure member constructed to slide into the said specially shaped pivot hub sockets of said pivot hub structure member to hold the said top part containing the pivot shaft structure member hingedly up at ninety degrees at one end over the said base part containing the said pivot hub structure member;

said top part containing the pivot shaft structure member and the said base part containing the pivot hub structure member interlocking to complete closure when the said top part containing the pivot shaft structure member is rotated at ninety degrees to the said base part containing the pivot hub structure member;

a set of metal conductor pins having sharp pointed ends molded to the top inside surface of said top part containing the pivot shaft structure member;

said metal conductor pins shaped in an arc and aligned to penetrate precisely and completely through the center of a source conductor and fixture conductors with minimal displacement of the cable insulation of the said source conductor and fixture conductors;

a set of conductor channels for each of the said source conductors and the said fixture conductors to hold them separately and securely; and a unique design of the said top part containing the pivot shaft structure member and the base part containing the said pivot hub structure member that allows for the smallest diameter of circumference at the mid section of the said cable connector assembly for the use of a closure device if needed to secure the cable connector in place permanently.

2. The cable connector assembly of claim 1 wherein by leveraging the connection between the top part containing the pivot shaft structure member and the base part containing the pivot hub structure member through the interlocking of the specially shaped pivot shaft and the specially shaped pivot hub sockets to one end of the connector assembly, the device is positioned to survive the use of sufficient force to penetrate both the source conductor and the fixture conductors.

3. The cable connector assembly of claim 1 wherein the interlocking of the specially shaped pivot shaft on the top part containing the pivot shaft structure member and the specially shaped pivot hub sockets on the base part containing the pivot hub structure member, prevents the two structures from moving in any direction and the assembly from releasing or separating once rotated 5° toward closure and through full closure.

4. The cable connector assembly of claim 1 wherein the base part containing the pivot hub structure member and the top part containing the pivot shaft structure member can be separated to allow the source conductor to be placed into the source conductor channel in the base part containing the pivot hub structure member without cutting or damaging the source conductor.

5. The cable connector assembly of claim 1 wherein the source conductor and the fixture conductors align together vertically in their respective conductor channels such that the metal conductor pins penetrate both sets of wires simultaneously to electrically connect them.

6. The cable connector assembly of claim 1 wherein the arc shape of the metal conductor pins enable precise penetration of the source conductor and the fixture conductors with minimal displacement of or damage to the stranded wire conductors or insulation of said conductors.

7. The cable connector assembly of claim 1 wherein the metal conductor pins are shaped to a fine point and with an arc aligned with the closure radius created by the pivot hub structure member and the pivot shaft member structure assembly such that electrical connection of the conductors, complete penetration of source and fixture conductors, and complete closure of the assembly can be achieved with the use of nominal hand force.

8. The cable connector assembly of claim 1 wherein specially designed ridges on the metal pin molds on the top part containing the pivot shaft structure member and another set of specially designed ridges on the base part containing the pivot hub structure member create a water tight seal with the source conductor insulation sheathing when fully closed.

9. The cable connector assembly of claim 1 wherein a raised ridge that runs the entire length of the source conductor channel in the base part containing the pivot hub structure member keeps the source conductor in the exact center and insures center penetration of the metal conductor pins on closure.

10. The cable connector assembly of claim 1 wherein the interlocking guide posts on the base part containing the pivot hub structure member engages with the interlocking guide slots on the top part containing the pivot shaft structure member to align the metal conductor pins with the center of each side of the source conductor and fixture conductor channels.

11. The cable connector assembly of claim 1 wherein the interlocking guide posts on the base part containing the pivot hub structure member engages with the interlocking guide slots on the top part containing the pivot shaft structure member with sufficient friction to secure the connector assembly closed permanently and prevents it from recoiling open.

12. The cable connector assembly of claim 1 wherein the fixture conductor channels on the base part containing the pivot hub structure member allow for the insertion of a water proofing agent such as silicone grease to augment the water tight seal achieved by the ridges on the top part containing the pivot shaft structure member and the base part containing the pivot hub structure member.

13. The cable connector assembly of claim 1 wherein the base part containing the pivot hub structure member may be constructed to accommodate optional conductor channel inserts to support variable source conductor gauges required for the various embodiments of the cable connector assembly.

14. The cable connector assembly of claim 1 wherein the source conductor and the fixture conductors align together vertically and laterally in their respective conductor channels, positioning the smaller and less durable fixture conductor directly in line with the larger and more durable source conductor, thereby providing an element of protection from damage to or displacement of the fixture conductor caused by an outside force impacting the assembly.

* * * * *